US005711110A

United States Patent [19]

Williams

[11] Patent Number: 5,711,110

[45] Date of Patent: Jan. 27, 1998

[54] VEHICLE PARKING BARRIER

[76] Inventor: J. Marlis Williams, 7480 Poppy St., Corona, Calif. 91719

[21] Appl. No.: 702,007

[22] Filed: Aug. 23, 1996

[51] Int. Cl.[6] ..... E01F 13/00; E01F 13/04

[52] U.S. Cl. ..... 49/35; 49/25; 49/131

[58] Field of Search ..... 49/35, 49, 25, 49/131; 404/6, 9

[56] References Cited

U.S. PATENT DOCUMENTS

| | | | |
|---|---|---|---|
| 3,061,960 | 11/1962 | Dull . | |
| 3,688,439 | 9/1972 | Doxsee . | |
| 3,956,853 | 5/1976 | Montgomery . | |
| 3,968,596 | 7/1976 | Danin | 49/49 |
| 4,050,190 | 9/1977 | Mazzone . | |
| 4,490,068 | 12/1984 | Dickinson | 49/49 X |
| 4,713,910 | 12/1987 | Quante . | |
| 4,762,439 | 8/1988 | Carlyle | 49/131 X |
| 5,018,902 | 5/1991 | Miller et al. | 49/131 X |
| 5,136,810 | 8/1992 | DeWitt, III | 49/49 |
| 5,228,237 | 7/1993 | Nasatka | 49/131 X |
| 5,438,799 | 8/1995 | Le Faucheur . | |
| 5,441,359 | 8/1995 | Filippi | 49/35 X |
| 5,452,964 | 9/1995 | Trouguboff . | |
| 5,466,088 | 11/1995 | Nasatka | 49/131 X |
| 5,474,017 | 12/1995 | Mohebbi et al. | 49/131 X |
| 5,509,754 | 4/1996 | Conigliaro . | |

FOREIGN PATENT DOCUMENTS

| | | | |
|---|---|---|---|
| 2195384 | 4/1988 | United Kingdom | 49/131 |
| WO 94/12731 | 6/1994 | WIPO | 49/131 |

*Primary Examiner*—Peter M. Cuomo
*Assistant Examiner*—Robert J. Sandy
*Attorney, Agent, or Firm*—Gordon K. Anderson

[57] ABSTRACT

A parking barrier permanently installed in vehicle parking surface, which has a base (20), with legs (22) embedded within the surface. A hinge plate (28) is attached to the base and allows the barrier to be rotated to a horizontal position permitting a vehicle to safely pass over the collapsed barrier. A channel shaped post (34) is pivotally attached to the hinge plate and a rigid strut (40) is retained on one end within the post and, on the other, to the hinge plate. The strut forms a right angle triangle with the post. A pull pin (46) holds the upper end of the strut in place and when removed, permits the barrier to be rotated horizontally removing the obstruction. A second, or electromechanical, embodiment utilizes a linear actuator (84) for the strut. An electronic controller (100) receives a signal through a coded radio frequency transmitter (102) and receiver (104) and, in turn, energizes the actuator to rotate the barrier into a horizontal position. Limit switches (120) and (122) control positioning and indicator lights (108) and (110) denote the barriers position. The electrical system operates on low voltage direct current supplied by a D.C. power supply (114).

17 Claims, 5 Drawing Sheets

68
66
7
64
62
58
46
70
2
48
52
34
40
3
30
32'
28
20
36
22
24
36'
8

42
60

26

VEHICLE PARKING BARRIER

TECHNICAL FIELD

The present invention relates to motor vehicle parking barrier posts in general. More specifically to a permanent hingeable post for reserving parking space, providing security and lockable access.

BACKGROUND ART

Previously, many types of barrier posts have been used in endeavoring to provide an effective means for producing a reserved parking space that may be hinged flat to allow access by authorized vehicles. In most cases this post has been limited to a simple lock that permits manual access to rotate the post to a horizontal position when unlocked. Some prior art utilizes permanently mounted tumbler locks and integral latches while others use removable padlocks to secure the barrier in the vertical position. Hinges allow rotation, in most instances, while others employ a pivotal joint that requires lifting for swinging the barrier out of the way of the vehicle. Some prior art even requires removing the entire post for access. In automatically controlled barriers a capstan is used to wind up, or release, a cable for the pivotal action, where others employ a pair of lever arms with cams and rollers to lift a box-like structure.

A search of the prior art did not disclose any patents that read directly on the claims of the instant invention, however, the following U.S. patents are considered related:

| U.S. Pat. No. | Inventor | Issue Date |
|---|---|---|
| 5,509,754 | Conigliaro | Apr. 23, 1996 |
| 5,452,964 | Trouguboff | Sep. 26, 1995 |
| 5,438,799 | Le Faucheur | Aug. 8, 1995 |
| 4,713,910 | Quante | Dec. 22, 1987 |
| 4,050,190 | Mazzone | Sep. 27, 1977 |
| 3,956,853 | Montgomery | May 18, 1976 |
| 3,688,439 | Doxsee | Sep. 5, 1972 |
| 3,061,960 | Dull | Nov. 6, 1962 |

Conigliaro, in U.S. Pat. No. 5,509,754, teaches a post which is seated into a firmly embedded bracket into a driveway. An ell-rod is interlocked with a padlock, preventing removal. The entire post must be removed for access.

U.S. Pat. No. 5,452,964 of Trouguboff, of France, discloses an element anchored in the ground to which a vertical barrier is pivotally mounted. A spring permits a vehicle to depress the barrier without damage. A lock is positioned on top of the barrier for securement.

Le Faucheur, also of France, in U.S. Pat. No. 5,438,799 employs a pivoting barrier with two bow-shaped pivot arms and a cover. A lever with two arms of different lengths swing about a stationary pivot device with the short arm connected to a barrier causing it to pivot when the lever is rotated about the stationary device. An actuation device acts upon the end of the longer arm. Rollers are used in conjunction with the levers.

Quante, in U.S. Pat. No. 4,713,910, utilizes a post anchored in the ground in a folding manner. An electrical drive is located within the post, which is actuated by a receiver in communication with a portable emitter. Solar cells provide the power and a drive consisting of a motor driven capstan, cable pulley, and cable, erect the post and it falls by gravity when deactuated.

U.S. Pat. No. 4,050,190, issued to Mazzone, is for a lockable obstruction post that is supported by a base member mounted at the entrance to a parking space. A pin connects a tube to the base, permitting pivotal and limited axial movement. A locking rod inside the tube and a compression spring urge the tube away from the base. When the post is manually pushed down, a latch end of the rod locks the tube in place. A key unlocks the rod permitting the post to move upwardly against spring pressure into a pivotal horizontal non-obstructing position.

Montgomery teaches, in U.S. Pat. No. 3,956,853, a pivotal barrier with a keyed shear pin to maintain its vertical orientation, while permitting horizontal positioning when unlocked.

U.S. Pat. No. 3,688,439, of Doxsee, discloses a pivotal barrier with a lockable internal member that is manually lifted to free the barrier for rotation.

Dull's U.S. Pat. No. 3,061,960 is for a hinged barrier with a keyed lock under a cap connected to a latch mechanism to lock the barrier in a vertical position.

It will be noted that all of the above prior art uses the structural integrity of a single non-reinforced post by itself for the strength of the parking barrier.

DISCLOSURE OF THE INVENTION

Theft of automobiles in the United States has unfortunately risen to gigantic proportions and is of major concern of all car owners. Permanent unattended parking spaces, such as carports or uncovered assigned spaces in apartment complexes have been a prime target for car thieves, as identification of a particular make or style is easy and access at odd hours is easily obtainable. It is, therefore, a primary object of the invention to provide a device that will secure an automobile in a parking space with safety and a guarantee of its integrity. The invention, as described herein, accomplishes this goal, as it is robust in appearance, having not only a sturdy channel shaped metallic strut positioned angularly, forming a gusseted barrier. Since the barricade is not just a single post, it provides additional strength that is obvious to the potential thief and, therefore, easier targets will be sought. Further, the strut positioned at the hypotenuse in a right triangle reinforces the upright post placing a compressive constraint on the strut when it is forced downward utilizing the maximum strength of the member. This massive stoutness prevents the thief from attempting to back over the barrier and bend it out of the way, as it would be obvious that major damage to the vehicle would occur. The barrier base contains downwardly extending angular legs embedded in concrete, which complete the ultimate strength and stoutness of the barrier. This heavy mass precludes someone from removing the barrier in its entirety without considerable effort and heavy tools. Another aspect of the primary object of the invention is that the barrier may be used to reserve the assigned parking space, such as in a carport or parking lot, keeping the space vacant until an authorized vehicle is present, eliminating great frustration on part of the vehicle driver.

An important object of the invention is the actual locking mechanism, which utilizes a tumbler lock completely embedded within a protected compartment integral with the barricade post itself and securely welded in place. The latch of the lock retains a large heavy pull pin that holds the strut in shear, creating an immensely strong interface.

Another object of the invention is the utilization of a vertical mast rising upward from the barrier, so as to be visible from within the vehicle. When backing out of a parking space, a driver habitually looks through the rear view mirror, immediately seeing the mast, eliminating the possibility of an accidental collision with the barrier.

Still another object of the invention is its ease of use, as the operation is simple and intuitively obvious. The driver just inserts the key into the lock and rotates the latch freeing the pull pin, which is removed and retained by a lanyard. The barrier is manually hinged downward until it lays flat on the paved surface. The driver then backs the car over the barrier and may leave it in the position until returning, or may rotate the post upright and replace the pin to reserve the parking space, as previously discussed.

Yet another object of the invention is directed to a second embodiment of the apparatus, which is electromechanically operated from within the vehicle. This automatic function is accomplished by utilizing a retractable strut in the form of a linear actuator having a threaded lifting screw and gear-motor. A remote controlled radio frequency transmitter, in conjunction with a coded radio receiver, receives a signal from the transmitter within the vehicle, energizing the actuator to pivot the barrier in the desired direction. The system employs low voltage direct current power that is easily installed, either underground, or on the surface in electrical conduit. The radio frequency transmitter and receiver are well known in the art and government approved for use with garage door openers. The invention provides safety features that include automatic cut-out, in the event the barrier strikes an object while pivoting the post. This protection is accomplished by stalling the linear actuator, causing an overload device to deenergize power to the motor. When the obstruction is removed, the barrier may then complete its travel after normalization of the circuit.

In the event that the radio transmitter is lost, or the electrical system inadvertently malfunctions, a mechanical manual override is provided that incorporates the same keyed tumbler lock and lanyard retained pull pin as the preferred embodiment. This operational system functions in the same manner as previously described, except a cover plate is loosened and slides on the outside of the post, instead of inside, otherwise the operation is identical.

It may be visualized that the second electromechanical embodiment is more convenient, in that the driver does not have to leave the vehicle to operate the barrier and, when leaving, it may be rotated flat, even before the driver actually enters the vehicle. However, as in most cases, this convenience involves more costly components, labor intensive electrical hook-up, thus increasing the initial expense of the apparatus.

These and other objects and advantages of the present invention will become apparent from the subsequent detailed description of the preferred and other embodiment, also the appended claims, further taken in conjunction with the accompanying drawings.

BEST MODE FOR CARRYING OUT THE INVENTION

Figures 1, 2, 3, 4, 5:
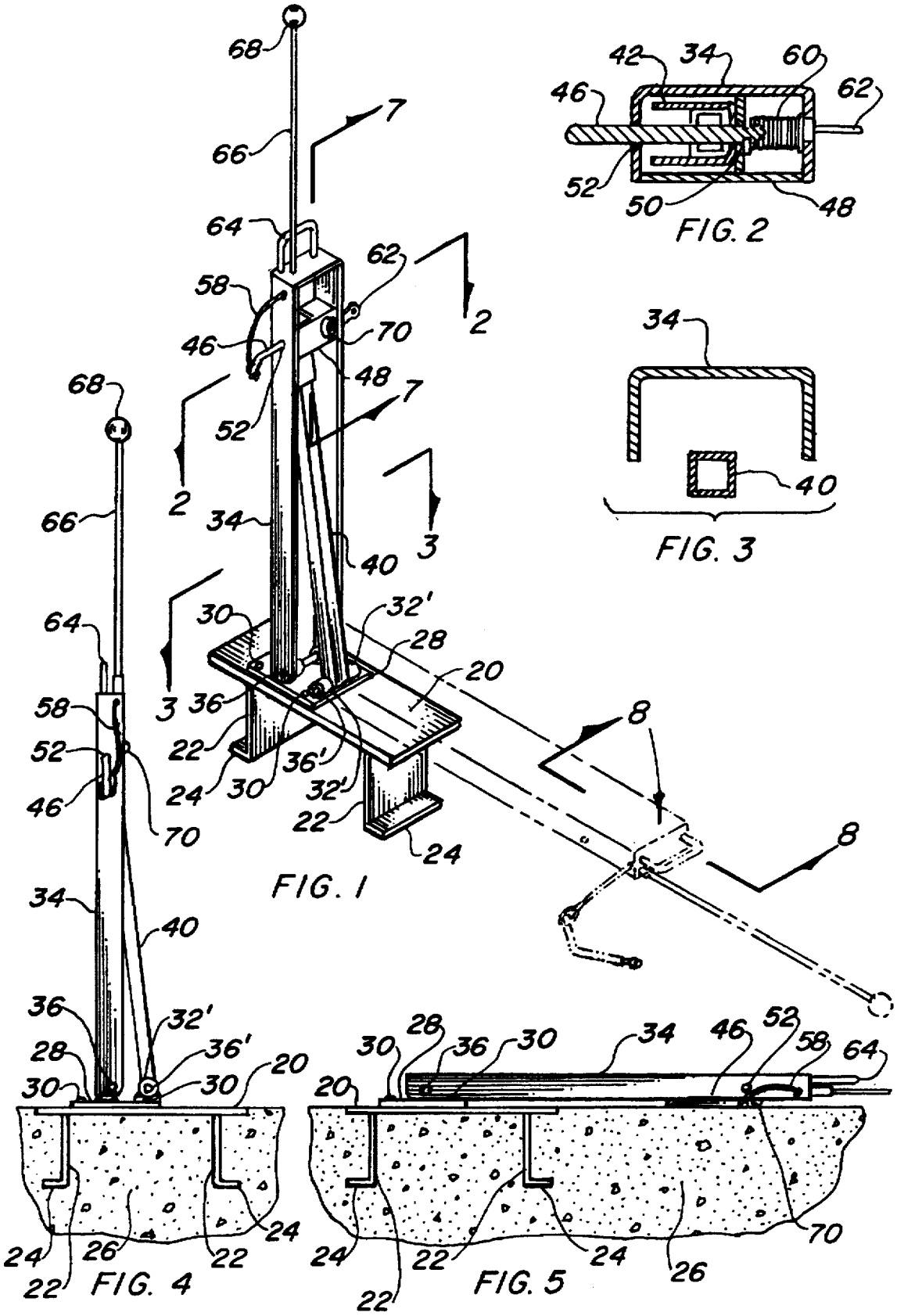
FIG. 1 is a partial isometric view of the preferred embodiment.
FIG. 2 is a cross-sectional view taken along lines 2—2 of FIG. 1 enlarged for clarity.
FIG. 3 is a cross-sectional view taken along lines 3—3 of FIG. 1 enlarged for clarity.
FIG. 4 is a side view of the preferred embodiment embedded in concrete, illustrated in its upright barrier position.
FIG. 5 is a side view of the preferred embodiment embedded in concrete, illustrated in its collapsed position.

The best mode for carrying out the invention is presented in terms of a preferred and second embodiment.

Both embodiments are primarily designed alike, except the second embodiment replaces a mechanical strut with an electrically operated linear actuator that retracts within itself. The second embodiment also includes an electronic controller with remote radio frequency transmitter receiver and visual indicators.

The preferred embodiment, as shown in FIGS. 1 through 9, is comprised of a base 20 of rigid flat plate metal stock with at least two attached angular legs 22 of the same material extending downwardly with opposed flanges 24. The legs 22 are preferably welded to the base 20 and the entire weldment is permanently embedded in concrete 26 within a parking surface. If the parking surface is asphalt and the barrier is installed at a later date, a hole is cut and filled with concrete 26 and the barrier, in its completed form, is embedded into the concrete flush with the top surface of the asphalt parking material. The legs 22, being angularly formed at the end, create a permanent and secure installation within the hardened concrete.

Hinge means in the form of a hinge plate 28 is attached to the base 20 by tamperproof screws 30, or the like. The hinge plate 28 permits the barrier to be rotated downwardly from an obstructive vertical position, as shown in FIG. 1. Alternatively, hinge pivot sockets 32, instead of being attached to the plate 28, may be welded directly to the base plate 20.

A pivoted barricade post 34, in channel shape, is swivelly attached to the hinge plate pivot sockets, with a hinge pin 36 penetrating through the post 34 and both sockets 32. This pivotal action permits the post to stand upright and is able to pivot downwardly in one direction, as legs on the channel shaped post 34 are radiused 38 on the outside bottom corners. The hinge pin 36 is pressed into holes in the post 34 for securement or welded into place for added safeguard and protection.

Figure 6:
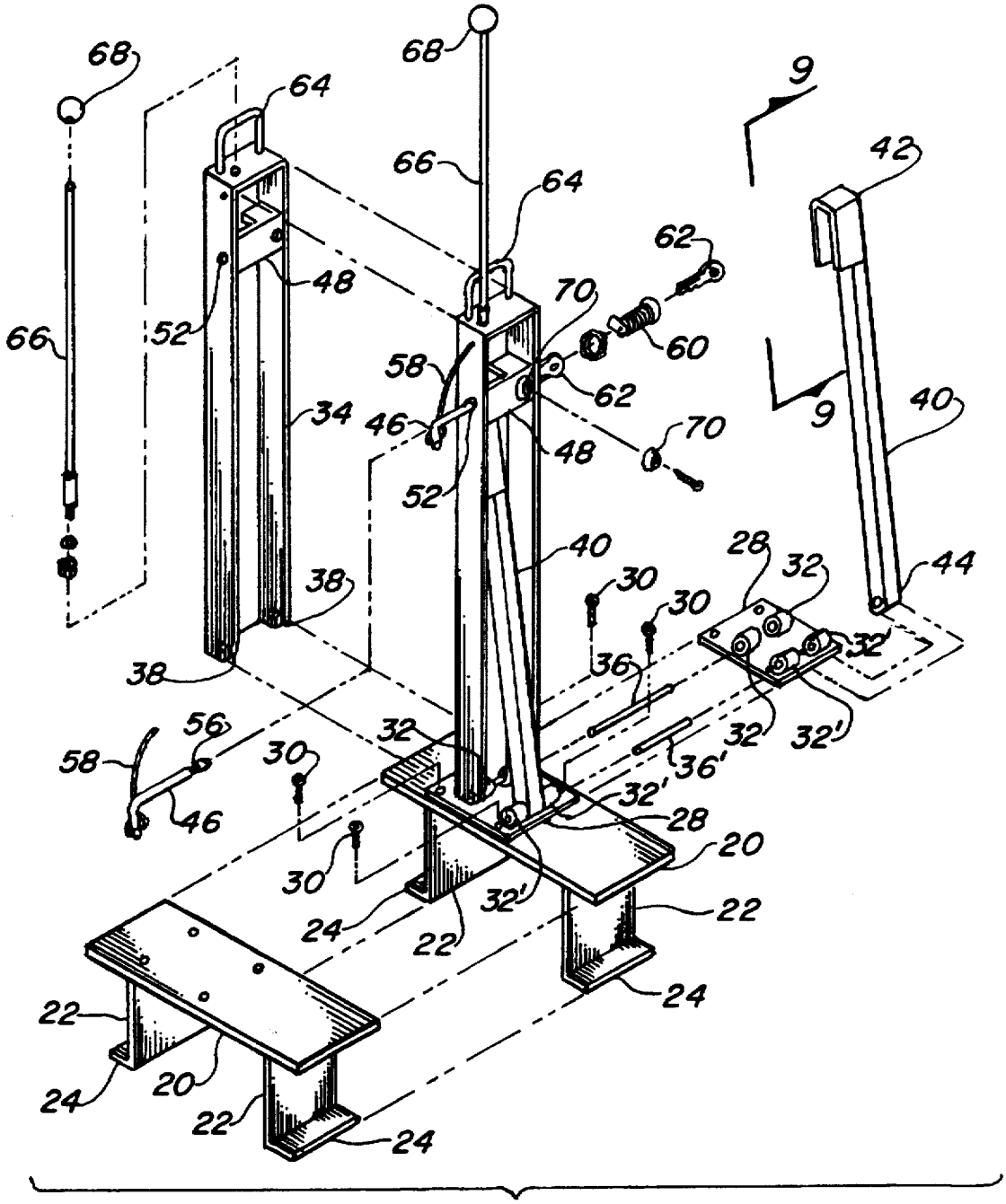
FIG. 6 is an exploded view of the preferred embodiment.

A structurally sound strut 40, rigid in nature, is retained within the confines of the channel shaped post 34. The strut 40 has a first end 42 and a second end 44, with the second end 44 attached with a hinge pin 36' to pivot sockets 32' welded onto the hinge plate 28, as shown in FIGS. 1, 4 and 6.

The post 34, base 20, and strut 40, are arranged in the form of a right angled triangle, as depicted in FIG. 4, with the strut 40 constituting the hypotenuse of the right angled triangle. As such, the post 34 is reinforced, since the strut 40 acts as a gusset-like member, adding to the structural integrity of the barrier when it is in a vertical position. Further, if the barrier is damaged, the combined post 34, strut and connecting hinge plate 28 may be removed and replaced en bloc by withdrawing the tamperproof screws 30 with a special tool.

Figure 9:
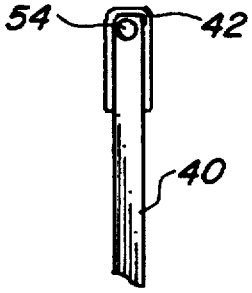
FIG. 9 is a cross-sectional view taken along lines 9—9 of FIG. 1 illustrating the hole for the pull pin in the strut.

Locking means, in the form of a lockable pull pin 46, is removably positioned between the post 34 and the strut 40. The post 34 includes a welded lock housing 48, having a first bore 50 in alignment with a second bore 52 in the barricade post 34. The strut 40 further contains a third bore 54 on its first end 42, as depicted in FIG. 9. The pull pin 46 is inserted into the three bores 50, 52 and 54, inflexibly securing the post 34 in the vertical position. As the pin 46 is in shear with the bores and is large in diameter, a minimum of ½ inch (1.27 cm), the connection has great strength.

Figure 7:
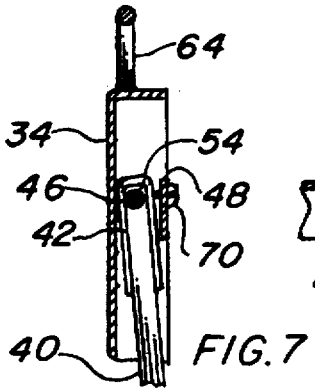
FIG. 7 is a cross-sectional view taken along lines 7—7 of FIG. 1 showing the barricade in the locked position with the pull pin in place.
Figure 8:
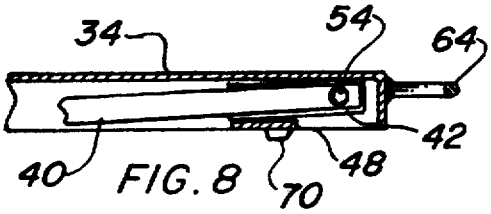
FIG. 8 is a cross-sectional view taken along lines 8—8 of FIG. 1 showing the barricade in the unlocked folded down position.

The pull pin 46 is of the bent type, having a truncated end and an adjacent groove 56 retained by a captivating lanyard 58. A keyed tumbler lock 60 with a rotatable pawl is securely contained within the lock housing 48 integral with the post 34. The pawl of the lock engages the groove 56 in the pin 46 securely detaining it in place until released by an authorized person having the corresponding key 62 for the lock 60. When the lock 60 is unlatched by the key 62, the pin 46 may be removed, permitting the post 34 to be rotated into a horizontal position parallel with the parking surface, as shown in FIG. 5. The strut 40 is retained within the channel shaped post 34 by the lock housing 48, as illustrated in FIGS. 6 through 8. FIG. 8 specifically depicts the relationship of the first end 42 of the strut 40 in the horizontal position with the pin 46 removed.

A handle 64 is attached to an upper end of the post 34 for manual manipulation in raising and lowering the post. FIGS. 1 through 8 illustrate this handle 64, which may be made of ⅜ inch (0.95 cm) diameter steel rod formed in channel shape. A coating of resilient material may be added to the handle 64 for appearance and to offer a firm gripping surface for the operator.

A warning mast 66 is also attached to the uppermost end of the post 34 opposite that which is swivelly attached to the hinge plate 28. This mast 66 extends upwardly a sufficient distance to caution the vehicle driver of the barricades presence, particularly when seen through the vehicles rear view mirror. A colored ball 68 may be added to the end of the mast 66, if desired, for further visibility.

A resilient bumper 70 is attached to the lock housing 48 integral with the post 34 for cushioning the post when the barrier has pivoted to a resting horizontal position on a parking surface.

The preferred material for the barrier is steel, with the base 20, legs 22 and hinge plate ¼ inch (0.64 cm) thick, and the barricade post 34 and lock housing 48 nominal ⅛ inch (0.32 cm) thick in either cold or hot rolled sheets. The strut 40 is preferably a ¾ inch (1.88 cm) seamed square tube, again of steel construction.

The second or electromechanical embodiment is illustrated in FIGS. 10 through 19. The basic arrangement and ultimate function remains the same, except for the electrical actuation of the barrier. The base 20' is essentially the same construction and material, however its rectangular shape is elongated and a rectangular slot 72 is provided in the centermost portion and enclosed on the underside with a tapered housing 74 integral with the base 20'.

An electrical conduit passageway 76 is further welded to the bottom of the base 20' extending from the housing 74 to the end of the base 20', providing containment for electrical wires. An additional leg 22' is added under the base of the same size and material, making a total of three legs. The center leg 22' is notched to clear the housing 74, as is the end leg 22' notched for the conduit passageway 76, best illustrated in FIGS. 10, 13 and 14. The configuration of the legs 22' is basically the same as the preferred embodiment, except for the notches.

Figures 10, 11, 12, 13, 14:
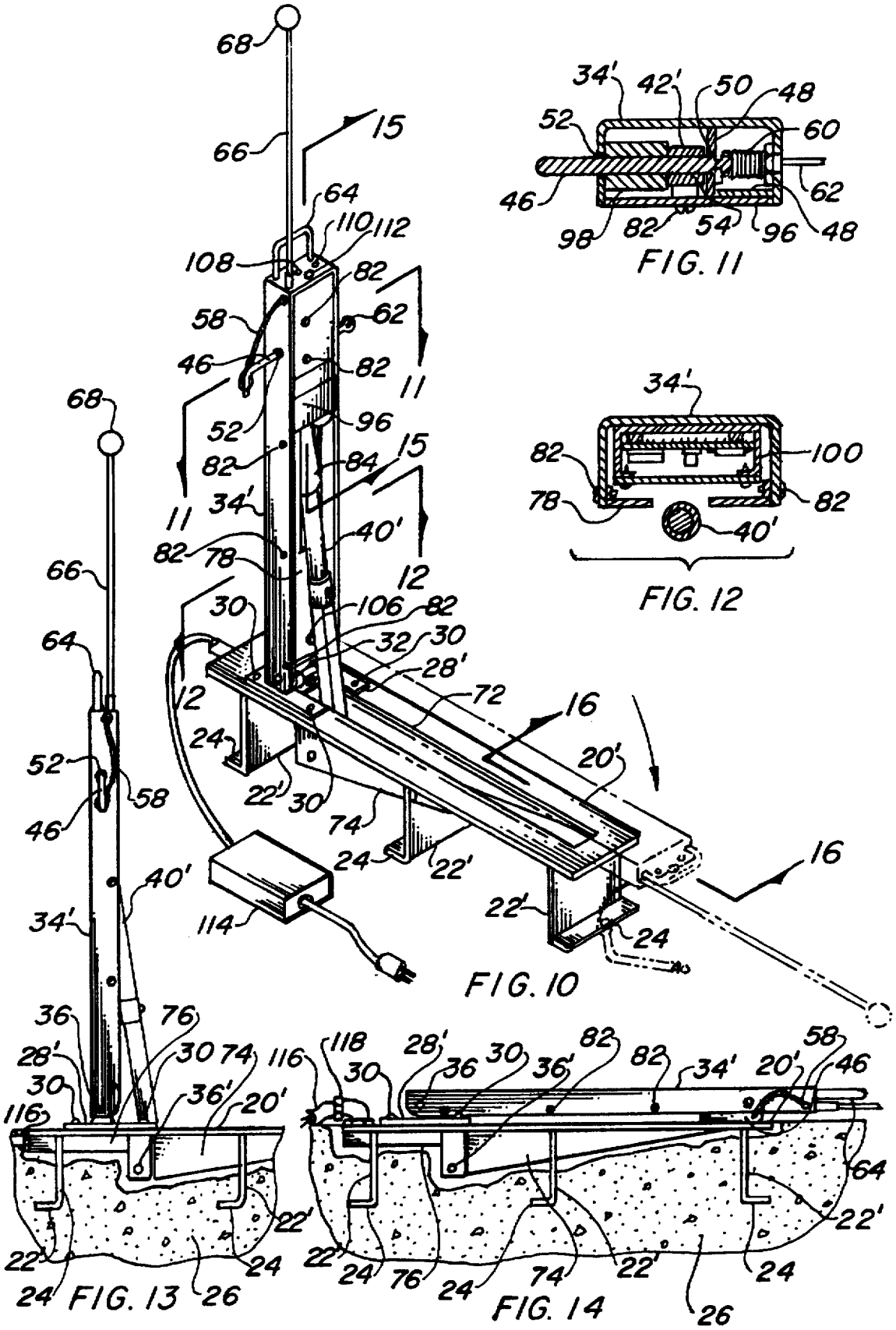
FIG. 10 is a partial isometric view of the second embodiment.
FIG. 11 is a cross-sectional view taken along lines 11—11 of FIG. 10 enlarged for clarity.
FIG. 12 is a cross-sectional view taken along lines 12—12 of FIG. 10 enlarged for clarity.
FIG. 13 is a side view of the second embodiment embedded in concrete, illustrated in its upright barrier position.
FIG. 14 is a side view of the second embodiment embedded in concrete, illustrated in its collapsed position.
Figures 15, 16, 17, 18:
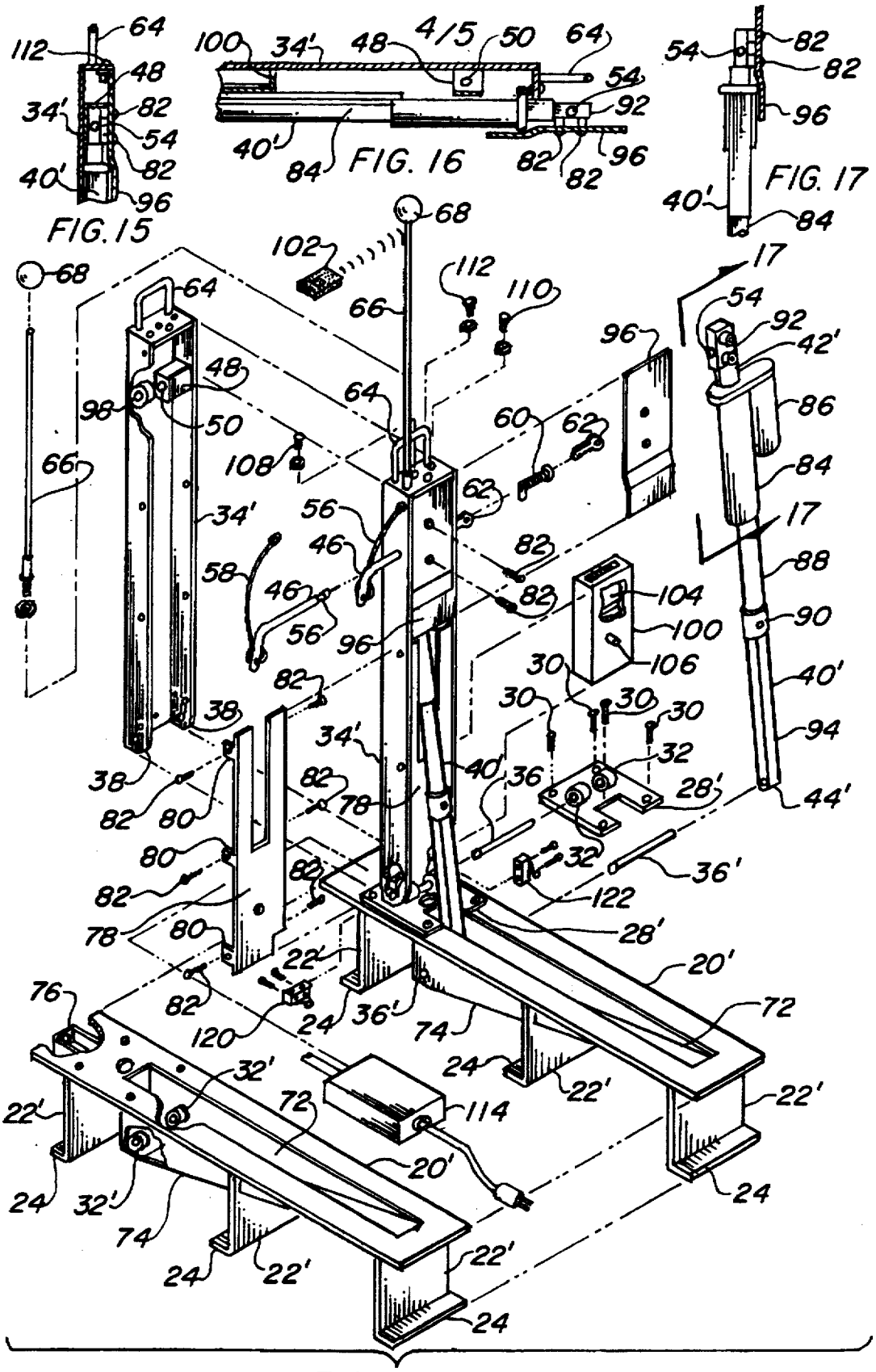
FIG. 15 is a cross-sectional view taken along lines 15—15 of FIG. 10 showing the barricade in the upright locked position with the pull pin in place.
FIG. 16 is a cross-sectional view taken along lines 16—16 of FIG. 10 showing the barricade in the horizontal unlocked folded down position.
FIG. 17 is a cross-sectional view taken along lines 17—17 of FIG. 18 illustrating the strut with the cover plate and fasteners removed for clarity.
FIG. 18 is an exploded view of the second embodiment.
Figure 19:
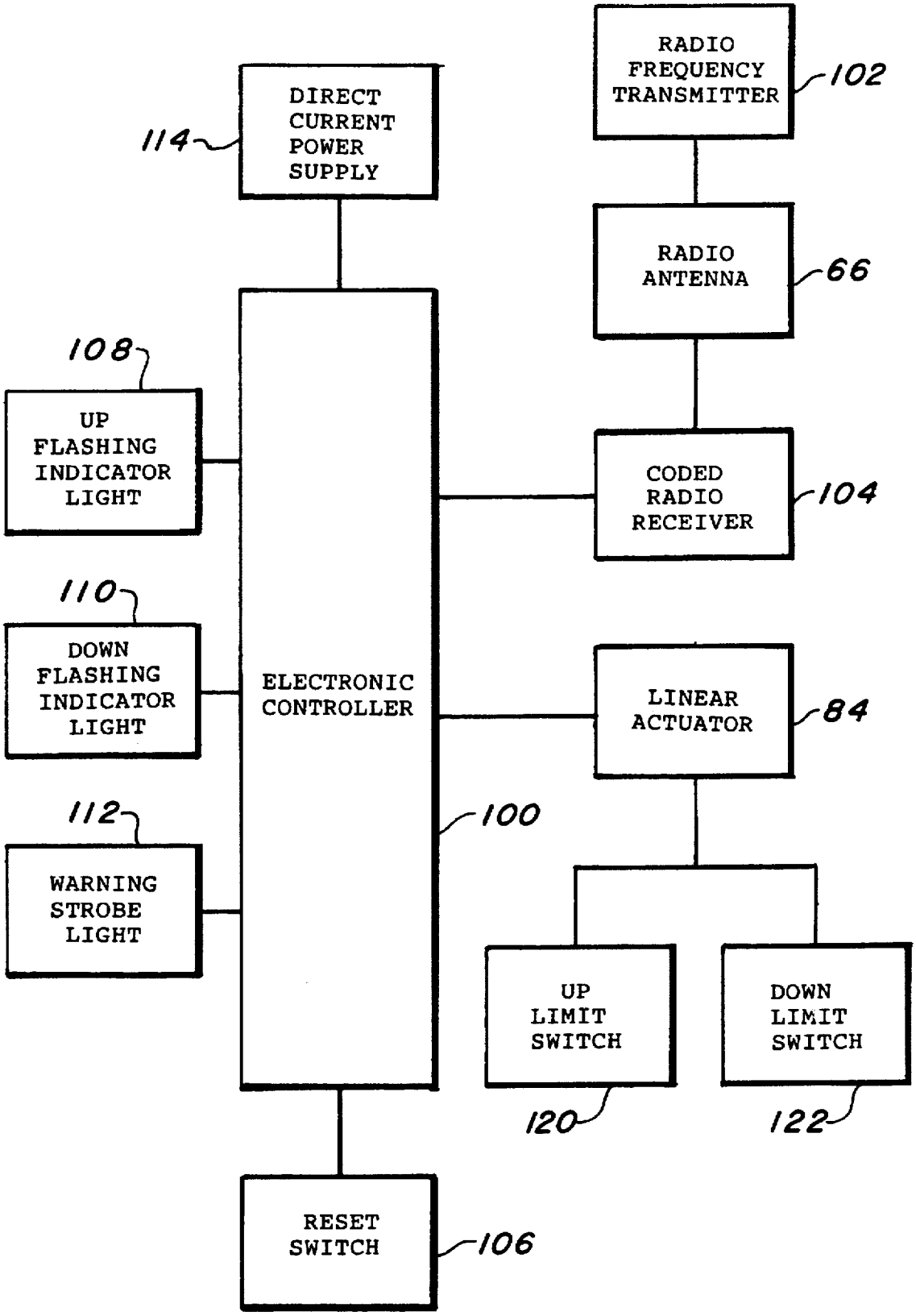
FIG. 19 is a block diagram of the electrical strut actuating means including the electronic controller and ancillary equipment.

The hinge plate 28' differs in that it is notched for the strut and the pivot sockets 32' are utilized elsewhere. The channel shaped pivotal barricade post 34' remains basically the same, except for the addition of holes to receive covers and electrical components. A notched cover 78 is attached to the lower portion of the post 34' with a number of bent tabs 80 and held in place with threaded fasteners 82, as shown in FIGS. 10 and 18.

The structurally sound strut 40' is retractable in this embodiment with its first end 42' retained within the confines of the channel shape of the post 34' and the second end 44' pivotally attached to the rigid base 20' with the hinge pin 36' unitedly penetrating the strut and the tapered housing 74 through sockets 32' located on each side. The strut 40' in this embodiment consists of an assembly, including electromechanical linear actuator 84 having a gearmotor 86, single lead lifting screw 88 enclosed in a protective cover, clevis 90, trunnion 92 and extension arm 94. The clevis 90 has an offset cover 96 attached with a pair of threaded fasteners 82. This offset cover 96 is the same configuration as the inside of the channel shaped barricade post 34'. The cover 96 protects the lock mechanism and is offset slightly to clear the strut in its horizontal position.

The lockable pull pin 46, lanyard 58, tumbler lock 60 and key 62 are exactly the same in this embodiment and function in the same manner. Since the strut 40' differs slightly in the configuration of its first end 42', a pin retaining sleeve 98 is added onto the post 34' in alignment with the pin 46, as shown in FIG. 11. The pin 46 penetrates the post 34', sleeve 98, trunnion 92 and lock housing 48, creating a robust pivot joint for the trunnion 92 of the strut 40'.

While the function of the pull pin 46 and locking mechanism in this second embodiment remain unchanged, the physical characteristics of the linear actuator 84 require a slightly different procedure in its detachment. As the barrier in the electromechanical embodiment is always operated remotely, the detachment of the strut 40' to the post 34' becomes a mechanical safety override permitting manual operation in the event of an electrical malfunction or power failure. The pin 46 is removed and retained by the lanyard 58, this detaches the trunnion 92 of the strut 40' and the entire strut 40', and its offset cover 96 is rotated slightly outwardly away from the post 34'. This movement frees the post 34' to be rotated downward and the strut 40' follows suit, sliding along with the post while the cover 96 acts as a gripping surface permitting the two separate structures to be rotated down into a horizontal position in concert.

The handle 64 and warning mast 66, with its optional colored ball 68 remain unchanged and no bumper is required in this embodiment.

The remote controlled retractable strut actuation means consists of a solid state electronic controller 100 that receives input and produces output to allow those authorized to remotely initiate pivoting the barricade post 34' electromechanically into a horizontal position by retracting the strut 40' within the post 34'. A remote hand held programmable radio frequency transmitter 102 is retained by the user, usually within the vehicle, and is capable of producing a detectable radio frequency signal. This type of remote transmitter is well known in the art and is used basically for overhead garage door openers. The transmitter 102 includes a selectable security code with numerous combinations to maintain individual security.

The radio signal sent by the transmitter 102 is received by the warning mast 66 that doubles as an antenna, as it is connected through a conduit to a coded radio receiver 104. The receiver 104 is also well known in the art and is used in conjunction with the transmitter 102 in the garage door opener industry. The receiver 104 includes a sealed mechanical relay and coded access switches that except a complex digital code signal from its companion transmitter 102. The receiver 104 filters out peripheral electrical noise and radio frequency interference in order to accept only the proper coded signal from the appropriate transmitter. The receiver 104 is preferably mounted in the same housing as the controller 100 and electrically interconnected.

The electronic controller includes a reset switch 106 accessible from the outside of its enclosure that distends through the notched cover 78, or a hole in the cover of sufficient size to permit access to the switch button. This reset switch 106 overrides an overload condition or inadvertent stoppage of the controller.

A pair of flashing indicator lights denote the barrier's position by color illumination and intermittent energization. A red "UP" flashing indicator light 108 registers that the barrier is vertical and in its obstruction position. A green "DOWN" flashing indicator light 110 registers that the barrier is collapsed into its horizontal position and ready to have the vehicle safely pass over. Preferably, the lights are mounted in the top of the post 34' near the handle 64 and mast 66.

An optional "WARNING" strobe light 112 may be added adjacent to the above lights 108 and 110 for drawing attention to the barriers presence.

The electrical system for the above controls operates on low voltage direct current, such as 12 volts D.C. This low voltage power is furnished to the barrier by a direct current power supply 114 that transforms and rectifies 60 hertz utility power to the desired 12 volts D.C. The power supply 114 is also well known in the art and may be of any compatible style and design. Preferably, the power supply 114 is located in a building or structure adjacent, or near, to the barrier and low voltage wiring may be directed to the barrier, either above or below the ground or parking surface level. FIG. 13 illustrates an electrical conduit 116 attached to the end of the conduit passageway 76 under the parking surface, and FIG. 13 depicts the conduit 116 interfacing through a connector 118 into the top of the base 20', allowing the wires to enter the conduit passageway 76. In the event a number of barriers are used in the same location, a single power supply 114 may be used for multiple operation.

It may be visualized that the interconnecting wiring for the barrier is enclosed within conduit 116, passageways 76, or protected behind covers 78 and 96 within the post 34'.

A pair of snap acting roller lever limit switches control the linear actuator 84 position. An "up" limit switch 120 is mounted with threaded fasteners 82 onto the post 34' behind the notched cover 78 interfacing with the hinge plate 28' when the post 34' is upright. A "down" limit switch 122 is similarly installed on one leg of the post 34' and extends through the lower corner notch in the cover 78 to contact the top surface of the hinge plate 28'. The switches 120 and 122 terminate rotation of the gearmotor 86 and properly position the barricade post 34'.

In operation the preferred embodiment is retracted from its vertical barrier position by removing the pull pin 46 and manually rotating the post 34 by the handle 64 until it rests flat on the parking surface. The second or electromechanical embodiment automatically rotates downward into the horizontal position when the transmitter 102 is manually energized by pressing its integral push-button switch. The linear actuator 84 is energized by the controller 100 and the actuator gearmotor 86 rotates onto the threads of the lifting screw 88 until the down limit switch 122 stops the movement. To elevate the barrier, the same procedure is followed in reverse, except the up limit switch 120 stops operation at the proper vertical position.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. A vehicle parking barrier permanently installed within a parking surface for withholding access and maintaining security of a motor vehicle comprising;

a base having downwardly extending angular legs permanently embedded within a parking surface, hinge means attached to the base for allowing the barrier to be rotated downwardly from an obstructive vertical position, a pivotal barricade post swivelly attached to the hinge means, a structurally sound strut having a first end and a second end, with the first end slideably retained within the post, and the second end attached to the hinge means, also the post, base and strut arranged in a form of a right angled triangle with the strut constituting a hypotenuse, and locking means disposed between the post and the strut for removably capturing the strut within the post for inflexible vertical securement while permitting authorized access to pivot the post into a horizontal position by sliding the strut therewithin.

2. A vehicle parking barrier permanently installed within a parking surface for withholding access and maintaining security of a motor vehicle comprising;

a rigid base having a plurality of downwardly extending angular legs permanently embedded within a parking surface, a hinge plate attached to the base for allowing the barrier to be rotated downwardly from an obstructive vertical position, a channel shaped, pivotal barricade post swivelly attached to the hinge plate, a rigid structurally sound strut having a first end and a second end, with the first end slideably retained within confines of the channel shape of the post, and the second end pivotally attached to the hinge plate, also the post, base and strut arranged in a form, of a right angled triangle with the strut constituting a hypotenuse, and a lockable pull pin disposed between the post and the strut for removably capturing the strut within the post for inflexible vertical securement while permitting authorized access by removing the pin and pivoting the post into a horizontal position sliding the strut within the post.

3. The vehicle parking barrier as recited in claim 2 further comprising a handle attached to the barricade post on an uppermost end, for manually lowering and raising the barrier.

4. The vehicle parking barrier as recited in claim 2 further comprising a warning mast fastened to the barricade post on an end opposite that which is swivelly attached to the hinge plate for cautioning vehicle drivers of the barriers presence.

5. The vehicle parking barrier as recited in claim 2 further comprising a resilient bumper attached to the post for cushioning when the barrier has pivoted and is resting in a horizontal position.

6. The vehicle parking barrier as recited in claim 2 wherein said lockable pull pin further comprises a bent pull pin retained by a captivating lanyard attached to the post, unitedly penetrating both the post and strut to form a secure connecting link therebetween, said pin further having a truncated end and a groove therein for locking.

7. The vehicle parking barrier as recited in claim 6 further comprising a keyed tumbler lock with a rotatable pawl securely disposed within the post adjacent to the pull pin with the pawl engaging the groove in the pull pin such that it is securely detained in place until released by a person authorized to move the barrier onto a parking surface.

8. A vehicle parking barrier permanently installed within a parking surface for withholding access and maintaining security of a motor vehicle comprising;

a rigid base having a plurality of downwardly extending angular legs permanently embedded within a parking surface, a hinge plate attached to the base for allowing the barrier to be rotated downwardly from an obstructive vertical position, a channel shaped pivotal barricade post swivelly attached to the hinge plate, a structurally sound retractable strut having a first end and a second end, with the first end retained within confines of the channel shape of the post, and the second end pivotally attached to the rigid base, also the post, base and strut arranged in a form of a right angled triangle with the strut constituting a hypotenuse, a lockable pull pin disposed between the post and the strut for mechanically capturing the strut within the strut within the post and permitting manual authorized alternative access by removing the pin and pivoting the post into a horizontal position, sliding the strut within the post, and remote controlled retractable strut actuation means in electrical communication with the retractable strut permitting those authorized to remotely initiate pivoting the post into a horizontal position by electromechanically retracting the strut within the post.

9. The vehicle parking barrier as recited in claim 8 further comprising a handle attached t0 the barricade post on an uppermost end, for manually lowering and raising the barrier.

10. The vehicle parking barrier as recited in claim 8 further comprising a combined radio antenna and warning mast fastened to the barricade post on an end opposite the hinge plate pivotal attachment for receiving radio transmission signals from the remote actuation means and for cautioning vehicle drivers of the barricades presence.

11. The vehicle parking barrier as recited in claim 8 further comprising;

a bent pull pin retained by a captivating lanyard attached to the post, unitedly penetrating both the post and strut to form a secure connecting link, also said pin having a truncated end and a groove therein for locking, and a tumbler lock with a rotatable pawl securely disposed within the post adjacent to the pull pin with the pawl engaging the groove in the pull pin, such that it is securely detained in place until released by one authorized to move the barrier.

12. The vehicle parking barrier as recited in claim 8 wherein said retractable strut further comprises an electromechanical linear actuator having a gearmotor, single lead lifting screw, enclosed in a protective tube, clevis, trunnion, extension arm and limit switches.

13. The vehicle parking barrier as recited in claim 12 wherein said strut actuation means further comprises an electronic controller and associated coded radio receiver for actuating the retractable strut to an appropriate position when remotely directed by a radio frequency signal.

14. The vehicle parking barrier as recited in claim 13 further comprising a hand held, remote, programmable radio frequency transmitter, containing a plurality of security code selections for emitting a radio frequency signal to the radio receiver and electronic controller for energizing the strut actuation means.

15. The vehicle parking barrier as recited in claim 12 further comprising visual flashing indicating lights denoting barrier position by color illumination and intermittent energization.

16. The vehicle parking barrier as recited in claim 15 further comprising a warning strobe light for visual indication of the barriers presence.

17. The vehicle parking barrier as recited in claim 16 further comprising a direct current power supply for furnishing electrical power to the electronic controller, radio receiver, indicating lights and linear actuator.

* * * * *